US012751562B2

(12) United States Patent
Pankratz

(10) Patent No.: US 12,751,562 B2
(45) Date of Patent: Oct. 6, 2026

(54) STRAP ARRANGEMENT FOR SECURING BOOSTER SEAT NEAR FRONT EDGE OF ADULT CHAIR

(71) Applicant: NUVATE INC., Oakville (CA)

(72) Inventor: Stephen Pankratz, Grimsby (CA)

(73) Assignee: NUVATE INC., Oakville (CA)

( * ) Notice: Subject to any disclaimer, the term of this patent is extended or adjusted under 35 U.S.C. 154(b) by 88 days.

(21) Appl. No.: 18/944,980

(22) Filed: Nov. 12, 2024

(65) Prior Publication Data

US 2025/0151925 A1 May 15, 2025

Related U.S. Application Data

(60) Provisional application No. 63/598,290, filed on Nov. 13, 2023.

(51) Int. Cl.
*A47D 1/10* (2006.01)

(52) U.S. Cl.
CPC ..... *A47D 1/103* (2013.01)

(58) Field of Classification Search
CPC ..... A47D 1/103; A47D 1/106; A47C 7/0213; A47C 1/16
USPC ..... 297/250.1, 252, 254, 257, 485
See application file for complete search history.

(56) References Cited

U.S. PATENT DOCUMENTS 1,429,867 A * 9/1922 Goldsmith ..... B60N 2/2812 297/250.1
1,974,619 A * 9/1934 Lubey ..... A47C 1/16 297/250.1
2,919,748 A * 1/1960 Alden, Sr. ..... A47D 11/02 108/135
2,979,121 A * 4/1961 Gates ..... A47D 1/008 297/487
3,002,788 A * 10/1961 Sutton ..... A47D 1/103 297/485
3,066,980 A * 12/1962 Clute ..... A47C 1/16 297/352
D204,190 S * 3/1966 Levy ..... D6/333
3,994,529 A * 11/1976 Lippert ..... A47C 1/16 297/134

(Continued)

FOREIGN PATENT DOCUMENTS

CA 200173 S 6/2022
CN 101233984 A 8/2008

(Continued)

OTHER PUBLICATIONS

Examination Report for Australian application No. 2018238363, IP Australia, dated: Mar. 4, 2022.

(Continued)

*Primary Examiner* — Maria E Graber
(74) *Attorney, Agent, or Firm* — Marc Lampert; Bhole IP Law

(57) ABSTRACT

A booster seat includes a horizontal strap that passes beneath the seat of the chair and a backrest strap that passes around the backrest of the chair to inhibit forward movement. A front edge strap is secured to the forward edge of the booster seat and passes beneath the chair seat to be secured to one of the straps or the booster seat to inhibit rearward movement and maintain the booster seat aligned with the forward edge of the chair.

8 Claims, 6 Drawing Sheets

(56) References Cited

U.S. PATENT DOCUMENTS 4,324,430 A * 4/1982 Dimas, Jr. ..... A47D 13/025 224/159
4,441,221 A 4/1984 Enste et al.
4,521,052 A 6/1985 Cone
4,583,253 A * 4/1986 Hall ..... B60N 2/2854 5/655
4,586,747 A 5/1986 Taylor
4,662,678 A 5/1987 Halpert
4,743,063 A 5/1988 Foster, Jr.
4,798,412 A 1/1989 Kohus et al.
4,867,504 A 9/1989 Johnson, Jr.
5,056,533 A * 10/1991 Solano ..... A61G 7/1023 5/655
5,335,968 A * 8/1994 Sheridan ..... A47D 1/004 297/DIG. 3
5,499,860 A * 3/1996 Smith ..... A47D 1/02 297/183.5
5,599,063 A 2/1997 Lister et al.
5,695,243 A * 12/1997 Anthony ..... B60N 2/2809 297/250.1
6,033,019 A * 3/2000 Hession-Kunz ..... A47D 1/002 297/256.13
6,123,390 A 9/2000 Greenwald
6,237,999 B1 * 5/2001 Hobson ..... B60N 2/2806 297/256.16
6,390,345 B1 * 5/2002 Brown ..... A45C 3/00 190/110
6,439,660 B1 * 8/2002 Guenther ..... B60N 2/2845 297/216.16
6,626,487 B1 9/2003 Buitendach
6,692,072 B2 * 2/2004 Nelson ..... A47D 15/006 297/250.1
6,773,064 B2 * 8/2004 Treen ..... A47D 1/103 297/255
6,832,813 B2 * 12/2004 Tomas ..... A47D 1/0085 297/475
6,877,176 B2 4/2005 Houghteling
7,032,970 B1 * 4/2006 Kharat ..... A47D 1/103 297/344.18
7,159,940 B1 * 1/2007 Atkins ..... A47C 3/18 297/344.26
D553,865 S 10/2007 Buitendach
D592,865 S 5/2009 Yeung
D617,103 S 6/2010 Bearup et al.
D623,426 S 9/2010 Ramer et al.
7,854,476 B1 * 12/2010 Liu ..... A47D 1/103 297/181
D660,606 S 5/2012 Dai
D660,607 S 5/2012 Dai
D667,229 S 9/2012 Sturmey
8,403,413 B2 * 3/2013 Scott ..... A47D 1/103 297/250.1
8,528,983 B2 * 9/2013 Curto ..... B60N 3/002 297/256.16
8,651,572 B2 2/2014 Medeiros et al.
8,672,403 B2 * 3/2014 Mendis ..... B60N 2/2806 297/256.16
8,764,109 B2 7/2014 Kummerfeld et al.
8,936,314 B2 * 1/2015 Lai ..... B60N 2/2842 224/159
9,603,464 B2 3/2017 Sclare et al.
D790,236 S 6/2017 Desnos
9,808,097 B2 * 11/2017 Whitt ..... A47C 7/425
10,383,458 B1 8/2019 Pagano
10,575,658 B2 * 3/2020 Romero ..... A47D 1/10
10,653,250 B1 5/2020 Flannery et al.
10,952,541 B2 3/2021 Pankratz
11,141,000 B2 * 10/2021 Mountz ..... A47D 1/103
11,160,379 B2 * 11/2021 Höhn ..... A47C 5/12
D957,147 S 7/2022 Pankratz
11,992,132 B2 * 5/2024 Longenecker ..... A47D 1/103
12,527,415 B2 * 1/2026 Hansen ..... A47D 1/103
2002/0135219 A1 9/2002 Rogers
2003/0067198 A1 * 4/2003 Treen ..... A47D 1/103 297/250.1
2007/0241597 A1 10/2007 Jimenez
2008/0054696 A1 3/2008 Mcconnell et al.
2008/0179931 A1 7/2008 Fritz et al.
2008/0315647 A1 * 12/2008 Carine ..... B60N 2/2884 297/250.1
2010/0052385 A1 * 3/2010 Martini ..... A47D 1/103 297/255
2010/0084901 A1 4/2010 Flannery et al.
2010/0244516 A1 9/2010 Fiore et al.
2010/0244518 A1 9/2010 Fiore et al.
2012/0104816 A1 5/2012 Flannery et al.
2012/0175922 A1 7/2012 Gillett et al.
2013/0057031 A1 3/2013 Kummerfeld et al.
2014/0077544 A1 * 3/2014 Gaudreau, Jr. ..... B60N 2/286 297/250.1
2014/0265487 A1 9/2014 Michelson
2015/0251567 A1 * 9/2015 Cohen ..... B60N 2/2812 297/250.1
2015/0336482 A1 * 11/2015 Pos ..... B60N 2/2821 297/250.1
2015/0359354 A1 12/2015 Greger
2016/0031343 A1 * 2/2016 Juchniewicz ..... B60N 2/269 297/250.1
2017/0119172 A1 5/2017 Sclare et al.
2018/0279799 A1 10/2018 Ingraham et al.
2019/0365103 A1 12/2019 Höhn
2019/0365118 A1 12/2019 Stachowski
2020/0046140 A1 2/2020 Pankratz
2020/0352350 A1 * 11/2020 Mountz ..... A47D 1/103
2021/0037989 A1 2/2021 Rogers et al.
2021/0161306 A1 6/2021 Dziak et al.
2022/0000274 A1 1/2022 Mountz et al.
2023/0017030 A1 * 1/2023 Rieu ..... A47D 1/10
2023/0200556 A1 * 6/2023 Pavan ..... A47D 1/103

FOREIGN PATENT DOCUMENTS

CN 103705033 A 4/2014
CN 204908735 U 12/2015
CN 205041074 U 2/2016
EP 1388311 A1 2/2004
JP 5599063 B2 8/2014
KR 20130128804 A 11/2013
WO 0065965 A1 11/2000
WO 03034873 A1 5/2003

OTHER PUBLICATIONS

Examination Report for Canadian application No. 3,053,425, CIPO, dated: Feb. 18, 2022.
Examination Report for European application No. 18772214.5, EPO, dated: May 2, 2024.
Examination Report for European application No. 18772214.5, EPO, dated: Aug. 10, 2023.
Examination Report for European application No. 18772214.5, EPO, dated: Dec. 13, 2024.
Extended European Search Report for European application No. 18772214.5, EPO, search completed: Sep. 18, 2020, communication dated: Sep. 29, 2020.
Intention to Grant for European application No. 18772214.5, EPO, dated: Dec. 9, 2024.
International Search Report for PCT application No. PCT/CA2018/050345, CIPO, search completed: Jul. 5, 2018, mailed: Jul. 5, 2018.
Notice of Acceptance for Australian application No. 2018238363, IP Australia, dated: Nov. 8, 2022.
Notice of Allowance for Canadian application No. 3,053,425, CIPO, dated: Apr. 11, 2022.
Notice of Allowance for U.S. Appl. No. 16/485,526, USPTO, dated: Feb. 10, 2021.
Notice of Decision to Grant for Japanese application No. 2020-500932, Japan Patent Office, dated: Sep. 27, 2022.
Office Action for Chinese application No. 201880019323.1, China National Intellectual Property Administration, dated: Sep. 19, 2022.

(56) References Cited

OTHER PUBLICATIONS

Office Action for Japanese application No. 2020-500932, Japan Patent Office, dated: Apr. 27, 2022.
Office Action for Mexican application No. MX/a/2019/011070, Mexican Institute of Industrial Property (IMPI), dated: Jun. 28, 2022.
Office Action for U.S. Appl. No. 16/485,526, USPTO, dated: Aug. 21, 2020.
Office Action for U.S. Appl. No. 16/485,526, USPTO, dated: Jan. 6, 2021.
Written Opinion of the International Searching Authority for PCT application No. PCT/CA2018/050345, CIPO, opinion completed: Jun. 29, 2018, mailed: Jul. 5, 2018.

* cited by examiner

STRAP ARRANGEMENT FOR SECURING BOOSTER SEAT NEAR FRONT EDGE OF ADULT CHAIR

FIELD OF THE INVENTION

The present application relates to booster seats.

BACKGROUND

Existing booster seats predominantly employ a harness of straps originating from the booster seat to secure the booster seat to a chair. The straps can be affixed either around an adult chair's backrest, termed "backrest straps," or around its seat, termed "horizontal seat straps" using adjustable buckles. For effective tension and secure placement, backrest straps necessitate the booster seat being pulled firmly against the stationary backrest of the adult chair. This design results in the booster seat being recessed back from the adult chair's front edge, leaving an exposed ledge between the front of the booster seat and the front edge of the chair. The seated child experiences discomfort due to their calves resting against the adult chair's front edge.

It is an object of the present invention to obviate or mitigate the above disadvantages.

SUMMARY OF THE INVENTION

In general terms, the present invention provides a booster seat with a first strap attached to the booster seat near its forward edge. This strap, referred to as the forward edge strap and which may be fabricated from a pliable material like nylon, runs from the seat's front face and under the seat of the chair so its distal end can be positioned beneath the adult chair's seat. The distal end of the forward edge strap is securely connected either to the horizontal seat straps, the backrest straps, or the booster seat's side or rear edges. The backrest straps inherently avert forward slippage of the booster seat, and when the forward edge strap is tightly engaged, it counteracts any backward motion, ensuring the booster seat's position remains optimal on the adult chair. When the backrest straps are adjusted and tightened, and the forward edge strap is also pulled tight and adjusted to the appropriate length, the forward edge strap counteracts any backward slippage, and allows the booster seat to be securely positioned in place towards the front edge of the adult chair.

Preferably each of the straps is adjustable to enhance the versatility of the booster seat and, accommodate adult chairs with a range of seat depths. As a result, a child seated in the booster seat experiences enhanced comfort with their legs resting naturally downward, achieving a knee angle of approximately 90 degrees.

In a particularly advantageous embodiment, the forward edge strap is integrated with the terminal ends of the horizontal seat straps using a 3-point harness system. Such 3-point harness systems are typically molded from plastic, and contain two separate male components and a third component that has two female ends that are able to receive the two male components. The horizontal seat strap has two sections, each secured to, and originating from opposite sides of the booster seat. The terminal ends of each of the two sections of the horizontal seat strap feature male buckle components. These male buckle components can be received and secured into dual female ends present on the buckle component which is present on the forward edge strap's end.

In a further embodiment, the horizontal seat strap has two sections, each fastened to, and originating from opposite sides of the booster seat. The terminal end of one of the two sections of the horizontal seat strap features a male buckle component. The terminal end of the other section of the other horizontal seat strap features a female buckle component. The male buckle component can be inserted into the female component, securing the two sections of the horizontal seat strap together around the seat of the adult chair, securing it in place. The distal end of the forward edge strap incorporates a loop, which can be positioned underneath the adult chair. In this embodiment of the invention, the horizontal seat strap can be secured around the base of the adult seat, independent of the forward edge strap. Either section of the horizontal seat strap can be threaded through the loop at the distal end of the forward edge strap, and secured to the other section of the horizontal seat strap by the male and female buckle components, securing the horizontal seat strap and the front edge straps together and around the seat of the adult chair.

BRIEF DESCRIPTION OF THE DRAWINGS

Embodiments of the invention will now be described with reference to the accompanying drawings in which.

DETAILED DESCRIPTION OF DRAWINGS AND PREFERRED EMBODIMENTS

Figure 1:
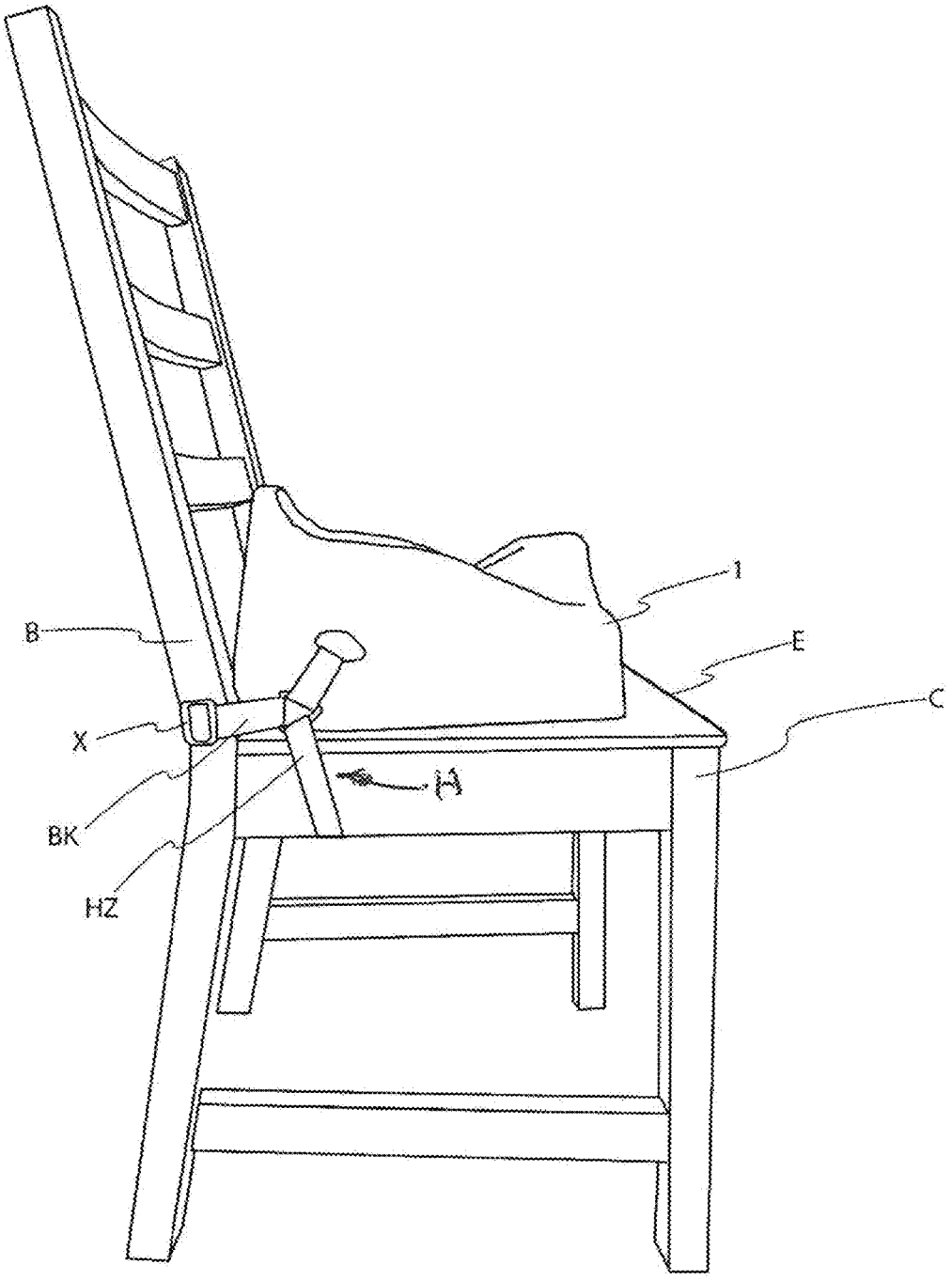
FIG. 1 PRIOR ART
FIG. 1 is a side view of one a typical prior art booster seat and strap arrangement.
Figure 2:
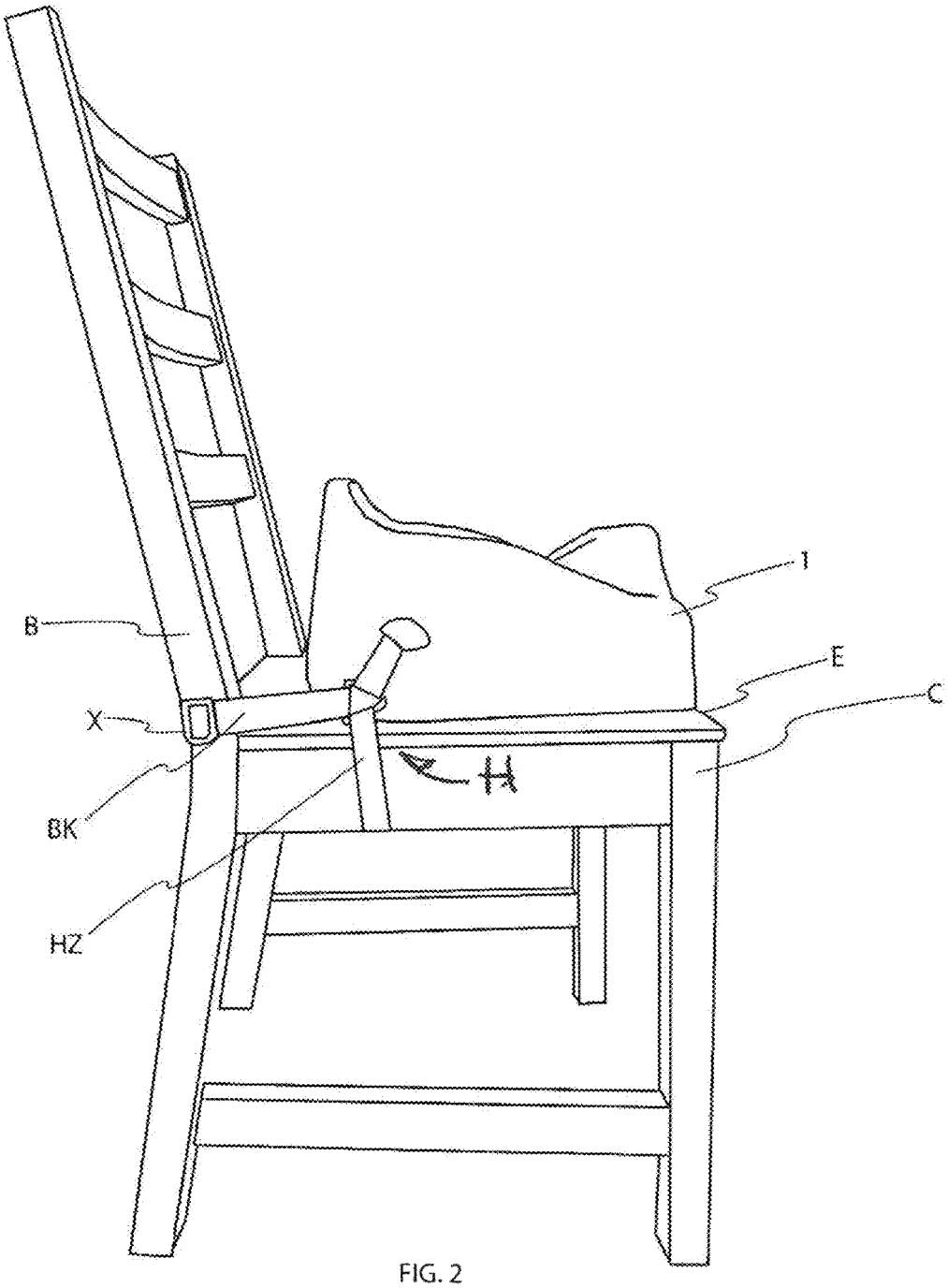
FIG. 2 is a side view of a first embodiment of the invention.

Referring to FIG. 1, an example of a typical booster seat 1, that is supported on an adults chair C to elevate an infant, has a base with an upwardly directed surface to support an infant. A harness generally indicate H includes a backrest strap BK secured to the booster seat 1 by, for example, passing through openings in the sides of the booster seat 1 and extends rearwardly from either side of the booster seat 1. The back rest strap BK passes around the backrest B of the chair C to inhibit forward movement relative to a backrest, B of the adult chair C.

The harness H also includes a horizontal strap HZ that extends to either side of the booster seat 1 and passes beneath the seat of the chair C.

Typically the straps BK, HZ are adjustable in length and opposite ends are connected by a releasable fastener to accommodate different dimensions of chair C. To provide stability for the booster seat 1, the backrest strap BK is adjusted to pull the booster seat 1 firmly against the stationary backrest B of the adult chair C, and the horizontal strap HZ adjusted to inhibit movement of the booster laterally and vertically. By tensioning the backrest strap BK, the front edge of the booster seat 1 is recessed back from the adult chair's front edge E. The arrangement and use of the booster seat in FIG. 1 is well known, as exemplified by the Upseat Boost Toddler Boost seat available from Nuvate Inc., Stoney Creek, Canada, and described and shown at https://theupseat.com/products/upseat-boost-seat-for-children, the contents of which are incorporated herein by reference and need not be described further.

Referring now to FIGS. 2 to 5, the harness H includes an additional strap FS, referred to for clarity as the forward edge strap FS, that is used to permit the front of the booster seat 1 to be aligned with the edge E of the chair C whilst maintaining the stability of the booster seat 1.

Figure 3:
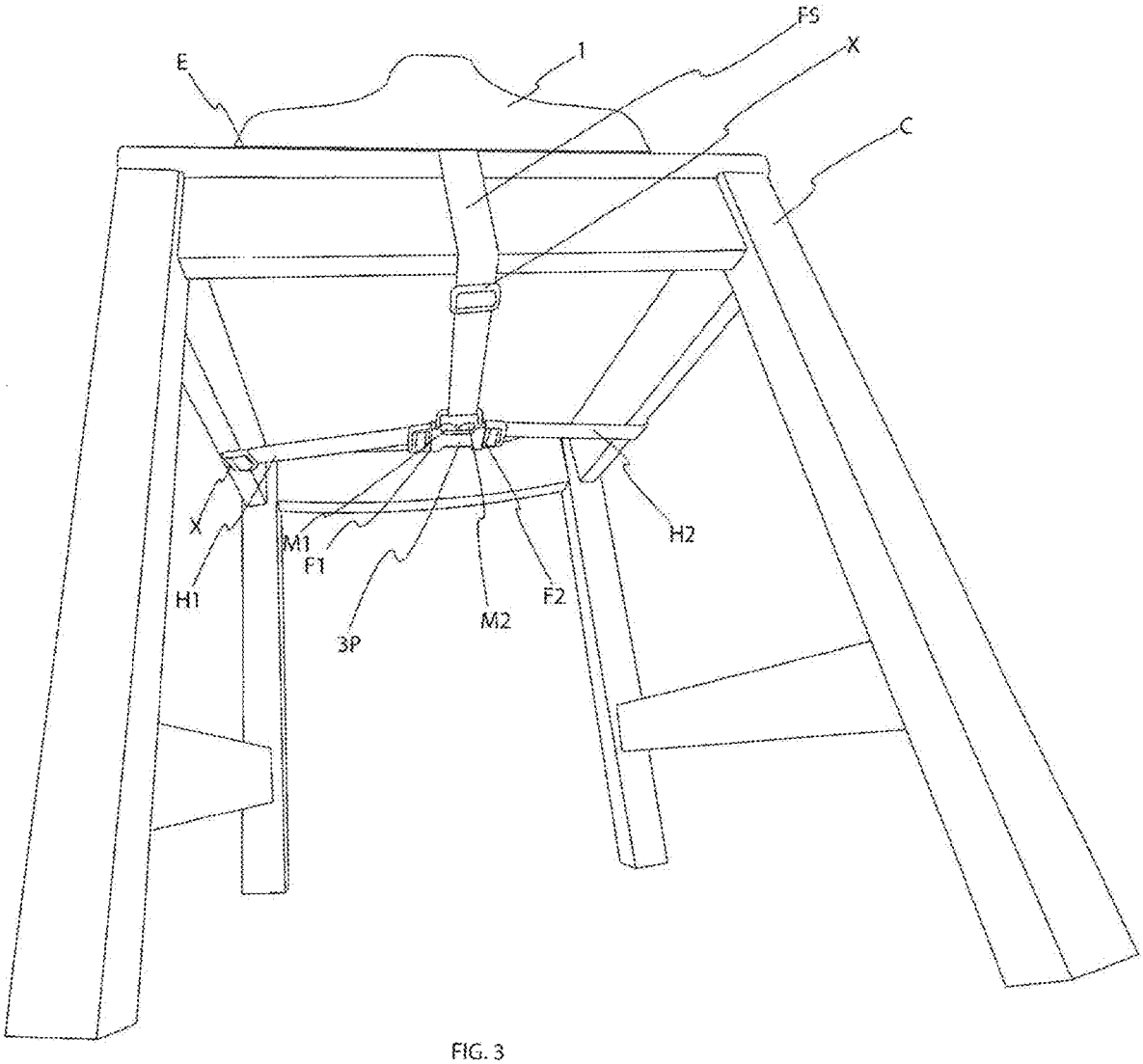
FIG. 3 is a bottom perspective view of FIG. 2.
Figure 5:
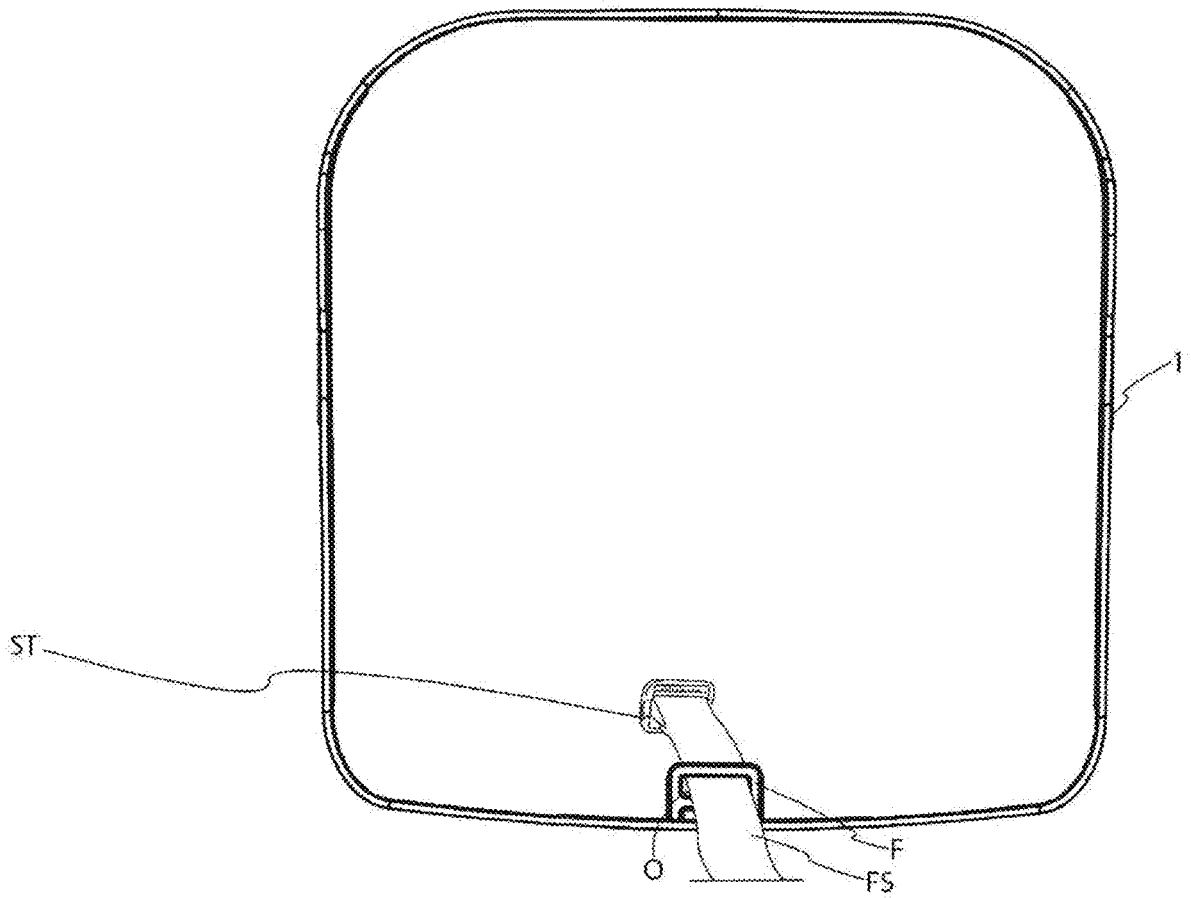
FIG. 5 is a bottom view of the underside of the booster seat shown in FIGS. 2, 3, and 4.

As can be seen in FIG. 3 the proximal end of forward edge strap FS is fixed to the booster seat 1 near the front of the booster seat 1. As best seen in FIG. 5, the booster seat 1 may conveniently have an orifice O in the base of 1. The proximal end of the forward edge strap FS features stopper ST which can be angled along a suitable profile to fit through the orifice O. As tension is placed on forward edge strap FS, the stopper ST is angled such that its largest profile is opposed by the frame F around the orifice O. This prevents the stopper ST from being pulled through O, fixing it in place.

Referring again to FIG. 3, the horizontal seat strap HZ has two sections, H1 and H2, each secured to, and originating from opposite sides of the booster seat. The terminal ends of sections H1 and H2 both incorporate a male buckle component, M1 and M2 respectively. The forward edge strap FS extends from the front face of the booster seat 1, and the distal end of the forward edge strap FS is connected to a releasable fastener in the form of a 3-point harness connector 3P. The connector 3P has dual female sockets, F1 and F2. The connector 3P is positioned beneath the adult chair's base, and buckle components M1 and M2 can be inserted into female sockets F1 and F2, thereby securing the two sections H1 and H2 of the strap HZ and the forward edge strap FS together around the seat of the adult chair C.

All straps are fabricated from a pliable material such as nylon, and can be adjusted in length using industry-standard adjusters X. When the sections H1, and/or H2, are tightened, and the forward extending strap FS is also pulled tight and adjusted to the appropriate length, it locates the booster seat 1 on the chair C with the front of the booster seat aligned with the front edge E. The backrest strap BK may then be tightened around the backrest B of the chair to firmly fix the position of the booster seat 1. The forward edge strap counteracts any backward slippage caused by the tension in the backrest strap BK, and allows the booster seat 1 to be positioned towards the front edge E of the adult chair, C.

Figure 4:
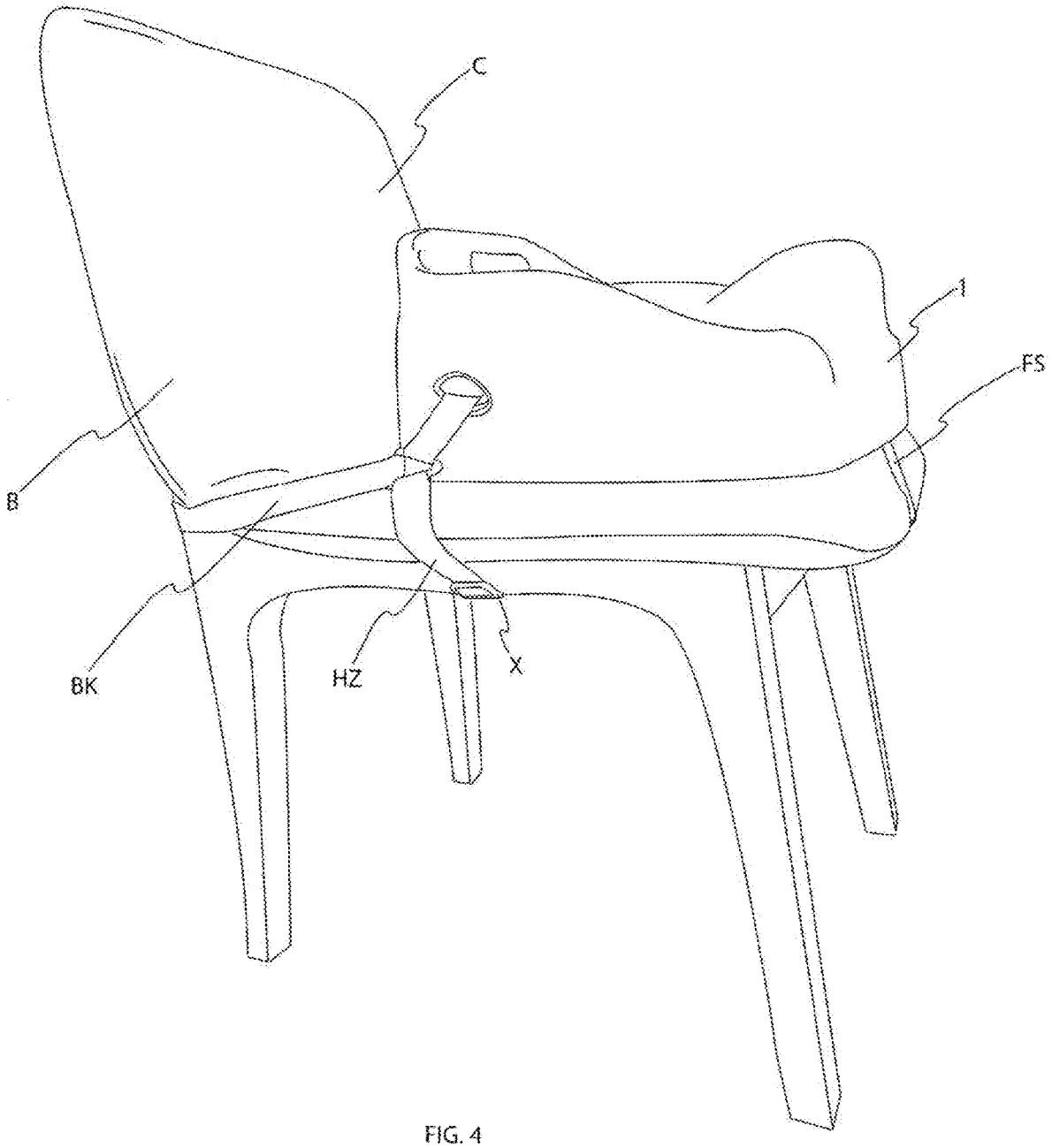
FIG. 4 is a side perspective view of the first embodiment of the invention on an alternative adult chair.

As can be seen in FIG. 4 the arrangement of the straps BK, HZ and FS can be adjusted to accommodate different size and styles of chair C. As in the embodiment of FIGS. 2, 3 and 5, booster seat 1 is positioned towards the front edge E of the adult chair, C. The straps HZ and FS are adjusted, and backrest straps BK tightened to counter pull from the forward edge strap FS to avert forward slippage of the booster seat. The harness H formed by straps HZ, BK and FS cooperate to secure the booster seat in place on the adult chair C, preventing horizontal and front/back slippage.

Figure 6:
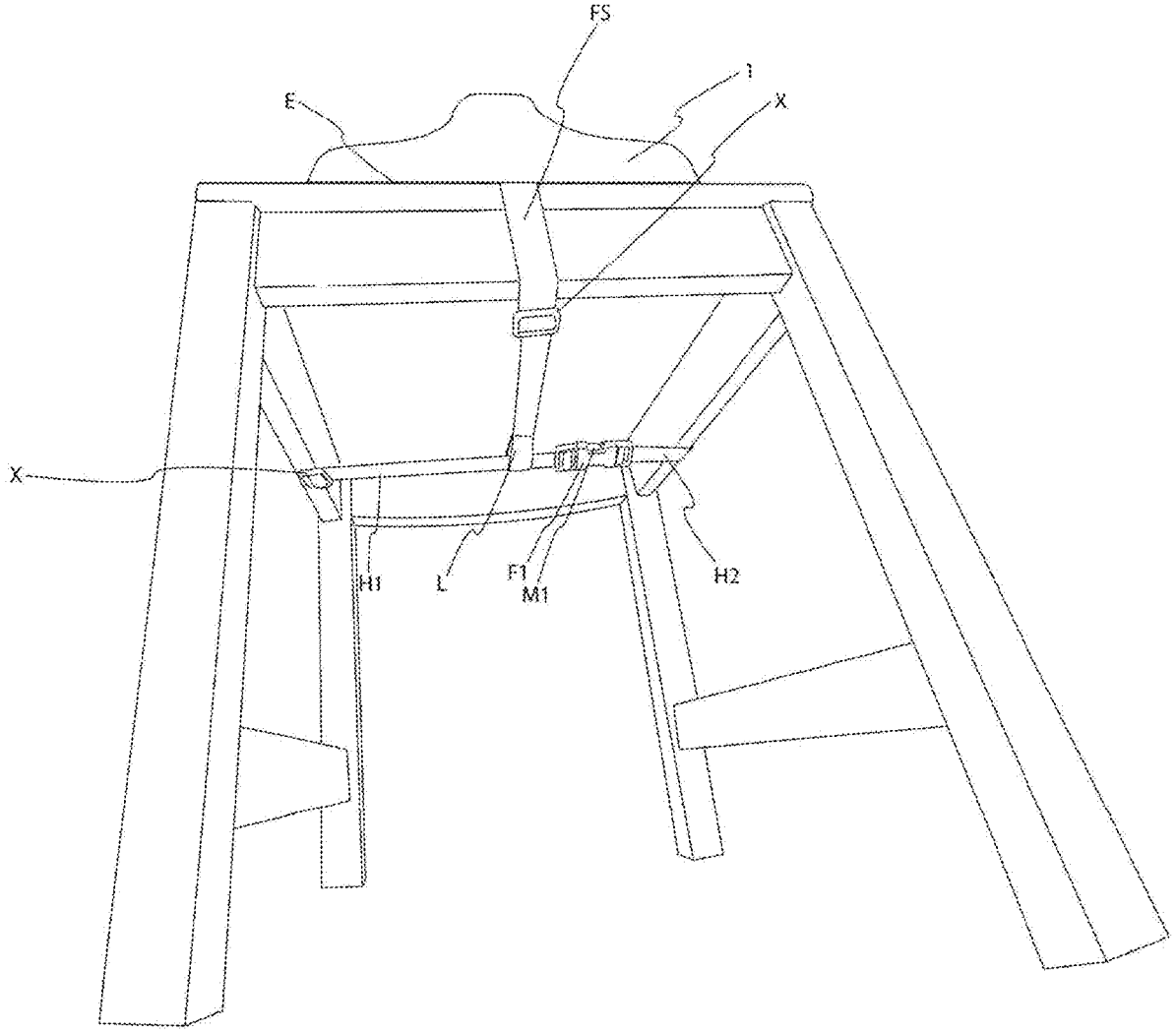
FIG. 6 is a bottom perspective view of an alternative embodiment of the invention.

Referring to FIG. 6, a further embodiment is shown in which the horizontal seat strap HZ has two sections, H1 and H2, each fastened to, and originating from opposite sides of the booster seat 1. The terminal end of section H1 incorporates a male buckle component M1 of a releasable fastener and the terminal end of section H2 incorporates a female buckle component F1 of the releasable fastener. The distal end of forward edge strap FS incorporates loop L which can be positioned underneath the seat of the chair C.

In use, the section H1 is threaded through the loop L, and the male buckle component M1 is inserted into and secured to the female buckle component F2, securing the sections H1 and H2 and the forward extending strap FS together and around the base of the seat of C. When the length of sections H1, and/or H2, is adjusted the strap HZ is tightened around the seat of the chair C. The forward edge strap FS may be adjusted in length by the adjusters X to the appropriate length to align the booster seat 1 with the front edge E of the chair C. The backrest strap BK is then tightened and the forward edge strap FS counteracts any backward slippage, and maintains the booster seat 1 in position towards the front edge E of the adult chair, C.

It will be appreciated that modifications may be made to the harness depending on the circumstances of its use. In one alternative embodiment, the horizontal strap may be deleted and lateral stability provided by the interaction of the front strap and backrest strap. As a further alternative the backrest strap may be omitted and the horizontal strap utilized to provide both lateral stability and fore and aft stability by engaging the substructure of the chair.

In each embodiment, the straps may be directly connected to one another or may be connected through the intermediary of the booster seat so that forces in one strap are transferred to other straps through the seat structure.

Although the foregoing has been described with reference to certain specific embodiments, various modifications thereto will be apparent to those skilled in the art without departing from the spirit and scope of the invention as outlined in the appended claims.

The invention claimed is:

1. A harness to secure and position a booster seat on a seat of a chair, the harness comprising;

a horizontal strap secured to the booster seat and positionable to extend beneath the seat of the chair;

a backrest strap secured to the booster seat and positionable to extend rearwardly around a backrest of the chair to inhibit forward movement of the booster seat relative to the chair;

a forward edge strap secured to the booster seat and positionable to extend over a forward edge of the chair, the forward edge strap connected to the horizontal strap to inhibit rearward movement of the booster seat relative to the chair, wherein the backrest strap and the forward edge strap generate opposing forces that maintain a position of the booster seat adjacent the forward edge of the chair.

2. The harness of claim 1, wherein the forward edge strap passes through an aperture in a seat surface of the booster seat to secure the forward edge strap to said seat.

3. A booster seat incorporating the harness of claim 1.

4. The harness of claim 1, wherein the horizontal strap, the backrest strap, and the forward edge strap are adjustable in length.

5. The harness of claim 4, wherein the forward edge strap is connected to the horizontal strap with a releasable fastener.

6. The harness of claim 5, wherein the releasable fastener comprises a male component secured to one of the forward edge strap or the horizontal strap and a female component secured to the other of the forward edge strap or the horizontal strap.

7. The harness of claim 5, wherein the forward edge strap terminates in a loop and the horizontal strap passes through the loop to secure the forward edge strap to the horizontal strap.

8. The harness of claim 7, wherein the releasable fastener comprises male components each secured to a respective one of sections of the horizontal strap or the forward edge strap, or both, and sockets to receive the male components.

* * * * *